US012209495B1

(12) United States Patent
Marquez et al.

(10) Patent No.: US 12,209,495 B1
(45) Date of Patent: Jan. 28, 2025

(54) ROTATABLE SLEEVE FOR DOWNHOLE TOOL

(71) Applicant: Halliburton Energy Services, Inc., Houston, TX (US)

(72) Inventors: Esiquiel Marquez, Carrollton, TX (US); Brian Williams Cho, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/236,102

(22) Filed: Aug. 21, 2023

(51) Int. Cl.
*E21B 7/06* (2006.01)
*E21B 41/00* (2006.01)

(52) U.S. Cl.
CPC ..... *E21B 7/061* (2013.01); *E21B 41/0035* (2013.01)

(58) Field of Classification Search
CPC ..... E21B 7/061; E21B 41/0035
See application file for complete search history.

(56) References Cited

U.S. PATENT DOCUMENTS 6,283,208 B1 9/2001 George et al.
6,315,054 B1 11/2001 Brunet
6,497,288 B2 12/2002 George et al.
7,231,980 B2 6/2007 Murray et al.
8,678,092 B2 3/2014 Assal et al.
9,540,921 B2 1/2017 Al-Ajaji et al.
2009/0218143 A1* 9/2009 Sanfelice ..... E21B 7/18 175/77

FOREIGN PATENT DOCUMENTS

WO 9712113 A1 4/1997

* cited by examiner

*Primary Examiner* — Dany E Akakpo
(74) *Attorney, Agent, or Firm* — Kilpatrick Townsend & Stockton LLP

(57) ABSTRACT

A system can be used to perform one or more tasks in a wellbore. The system can include a downhole tool and a rotatable sleeve. The downhole tool can be positioned in a wellbore for performing one or more tasks associated with a wellbore operation. The rotatable sleeve can be positioned in the downhole tool. The rotatable sleeve can be rotated within the downhole tool into a first configuration and into a second configuration. In the first configuration, a first window of the downhole tool can be aligned with a second window of the rotatable sleeve to facilitate a first task in the wellbore. In the second configuration, the first window can be misaligned with the second window to facilitate a second task in the wellbore. The first task can be different than the second task.

20 Claims, 7 Drawing Sheets

ROTATABLE SLEEVE FOR DOWNHOLE TOOL

TECHNICAL FIELD

The present disclosure relates generally to wellbore operations and, more particularly (although not necessarily exclusively), to a rotatable sleeve for a downhole tool.

BACKGROUND

Wellbore operations may include various equipment, components, methods, or techniques to form a wellbore, to displace and release hydrocarbon fluids using a wellbore or flowline, and the like. The wellbore operations can include one or more downhole tools that can seal at least a portion of a wellbore, can deflect tools from the wellbore to lateral wellbores, etc. Removing a first downhole tool that performs a first task in the wellbore to position a second downhole tool that performs a second task in the wellbore can take excessive time, excessive resources, and the like.

DETAILED DESCRIPTION

Figure 1:
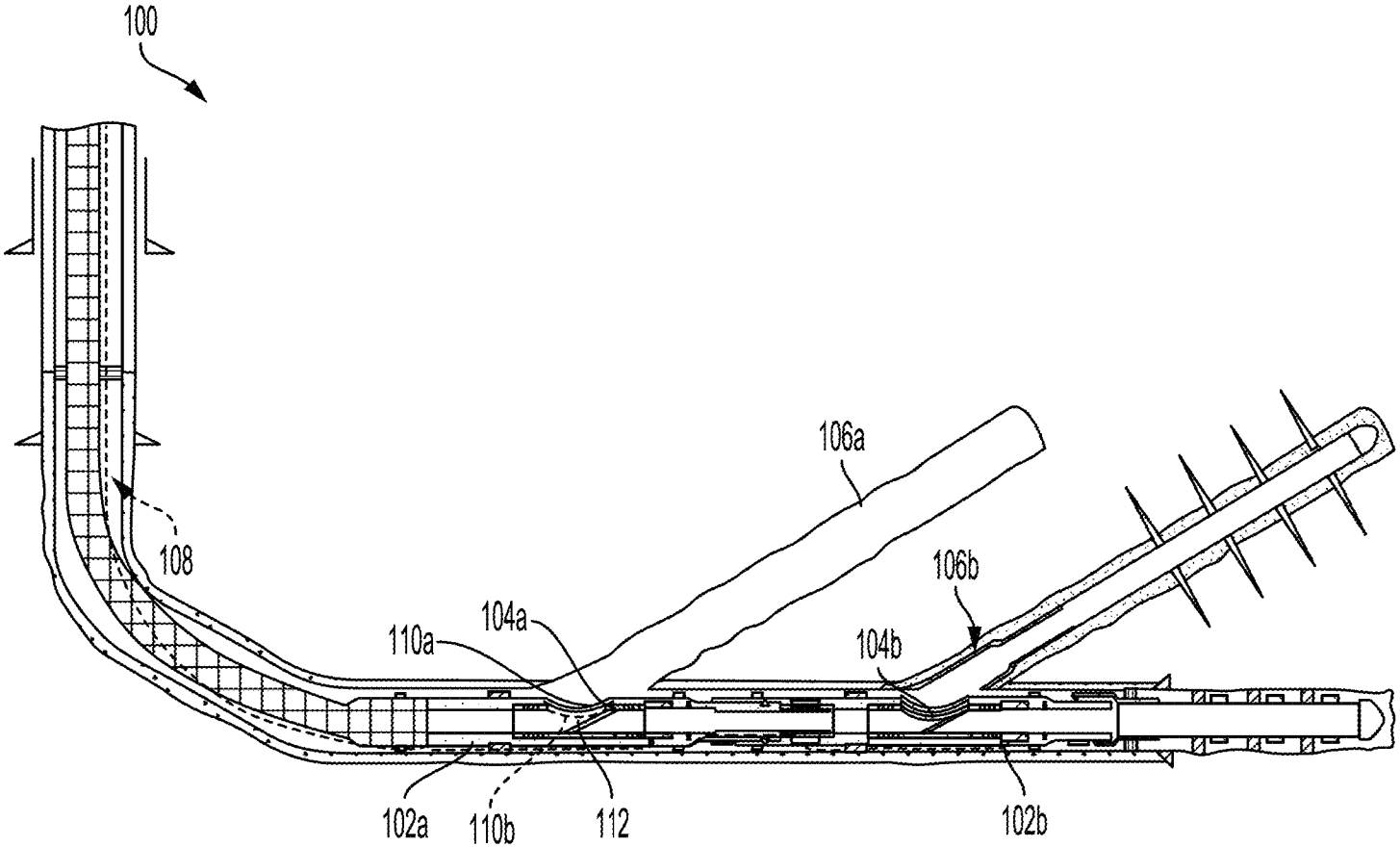
FIG. 1 is a sectional view of a wellbore that has a downhole tool that includes a rotatable sleeve according to one example of the present disclosure.

Certain aspects and examples of the present disclosure relate to a downhole tool that includes a rotatable sleeve. The downhole tool can be positioned in a wellbore to perform one or more tasks for a wellbore operation, which may include a wellbore drilling operation, a wellbore completion operation, a wellbore stimulation operation, a wellbore production operation, and the like. The one or more tasks can include a sealing task to seal at least a portion of the wellbore, a deflection task to deflect a tool from the wellbore to an adjacent, lateral wellbore, and other suitable tasks that can be performed by the downhole tool in the wellbore. The downhole tool may include at least one opening that can define a first window through which tools, material, and the like can pass. The rotatable sleeve can be positioned in or otherwise with respect to the downhole tool to facilitate the one or more tasks. In one particular example, the rotatable sleeve can be positioned in an interior region of the downhole tool. The rotatable sleeve can include at least one opening that can define a second window through which tools, material, and the like can pass. The rotatable sleeve can be rotated to align or misalign the first window and the second window. For example, the rotatable sleeve can be rotated to align the first window and the second window to allow tools, material, or the like to pass from the wellbore to an adjacent or lateral wellbore. Additionally or alternatively, the rotatable sleeve can be rotated to misalign the first window and the second window to facilitate sealing at least a portion of the wellbore or the adjacent or lateral wellbore.

Wellbore operations can involve more than one task or more than one sub-operation with respect to a wellbore. For example, a first downhole tool can be positioned in the wellbore to perform a first task, and a second downhole tool can be positioned in the wellbore to perform a second task that may be different than the first task. The first downhole tool and the second downhole tool may not be able to be positioned or installed in the wellbore substantially contemporaneously or may otherwise involve intervention trips to support such positioning. For example, a wellbore operation may involve multiple intervention trips to install a tubing pressure isolation, install a tubing exit whipstock to deflect into a lateral wellbore, other tools or material, or any combination thereof. The multiple intervention trips may be time-consuming, resource-heavy, technically challenging, or any combination thereof. Additionally or alternatively, the multiple trips may involve wireline or coil tubing for intervention work that may increase a number of intervention trips for performing tasks in the wellbore.

A downhole tool that includes a rotatable sleeve can be used to perform more than one task in the wellbore. In a particular example, the downhole tool can be built with the rotatable sleeve that may include isolation sleeve, a deflector or deflection ramp, etc., and the isolation sleeve and the deflector can be controlled electrically to rotate the isolation sleeve. In some examples, the rotatable sleeve can include an opening that can define a second window, which may allow access to a lateral wellbore adjacent to the wellbore. Additionally or alternatively, a ramp positioned in the rotatable sleeve can be used to guide intervention tools into the lateral wellbore or for other suitable purposes.

The rotatable sleeve can include the opening that can define the second window, a tubing exit whipstock, and any other suitable components for the rotatable sleeve. The rotatable sleeve can be installed in the downhole tool in an initial configuration in which the second window is not exposed to an exterior of the downhole tool. The rotatable sleeve can be rotated, for example using electrical energy, using hydraulic energy, or a combination thereof, to align the second window of the rotatable sleeve with a first window of the downhole tool. The tubing exit whipstock may additionally or alternatively be aligned with the intervention assembly to go into the lateral wellbore.

The rotatable sleeve can be rotated to at least a first configuration and a second configuration. The first configuration can involve the first window of the downhole tool being aligned with the second window of the rotatable sleeve. For example, and in the first configuration, a first direction measured from the first window may be approximately similar or identical to a second direction measured from the second window. Additionally or alternatively, and in the second configuration, the first direction measured from the first window may be approximately opposite, such as offset by approximately 180°, with respect to the second direction measured from the second window. Any other configuration or difference between the first direction and the second direction can be possible with the rotatable sleeve.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a sectional view of a wellbore 100 that has a downhole tool 102 that includes a rotatable sleeve 104 according to one example of the present disclosure. As illustrated in FIG. 1, the wellbore 100 may be positioned adjacent to a first lateral wellbore 106*a* and a second lateral wellbore 106*b*, both of which may originate from a different point along the wellbore 100. Other suitable numbers (e.g., less than two or more than two) of lateral wellbores are also possible. As illustrated in FIG. 1, two downhole tools, a first downhole tool 102*a* and a second downhole 102*b*, are positioned in the wellbore 100 proximate to the first lateral wellbore 106*a* and the second lateral wellbore 106*b*, respectively, though other arrangements of the first downhole tool 102*a* and the second downhole 102*b* are possible.

The downhole tool 102, such as the first downhole tool 102*a*, can be positioned in the wellbore 100 using a work string 108 or using any other suitable conveyance tools or operations that can position the downhole tool 102 in the wellbore 100. The downhole tool 102 can be positioned approximately adjacent or otherwise proximate to the lateral wellbore 106 such as the first lateral wellbore 106*a*. The rotatable sleeve 104, such as rotatable sleeve 104*a*, can be rotated into a first configuration that can allow tools, material, and the like to be pass through the downhole tool 102 and into the lateral wellbore 106, or vice versa. Additionally or alternatively, the rotatable sleeve 104, such as the rotatable sleeve 104*a*, can be rotated into a second configuration that can allow the wellbore 100, the lateral wellbore 106, or any portions or subsets thereof to be sealed. The rotatable sleeve 104 can be rotated into any other suitable configuration to facilitate any other suitable task to be performed in the wellbore 100 or the lateral wellbore 106.

In some examples, the downhole tool 102 can include a first opening that can define a first window 110*a*, and the rotatable sleeve 104 can include a second opening that can define a second window 110*b*. The first window 110*a* and the second window 110*b* can have the same or similar shape, the same or similar size, and the like. For example, the first window 110*a* and the second window 110*b* can be rectangular, circular, elliptical, or the like. Additionally or alternatively, the first window 110*a* and the second window 110*b* may be sized to be within approximately +/−10% of one another, for example to allow a tool to be able to pass through the first window 110*a* and the second window 110*b*. Additionally or alternatively, the rotatable sleeve 104 can include a deflection ramp 112 that can allow tools, material, or the like to be deflected from the downhole tool 102 to the lateral wellbore 106.

Figure 2:
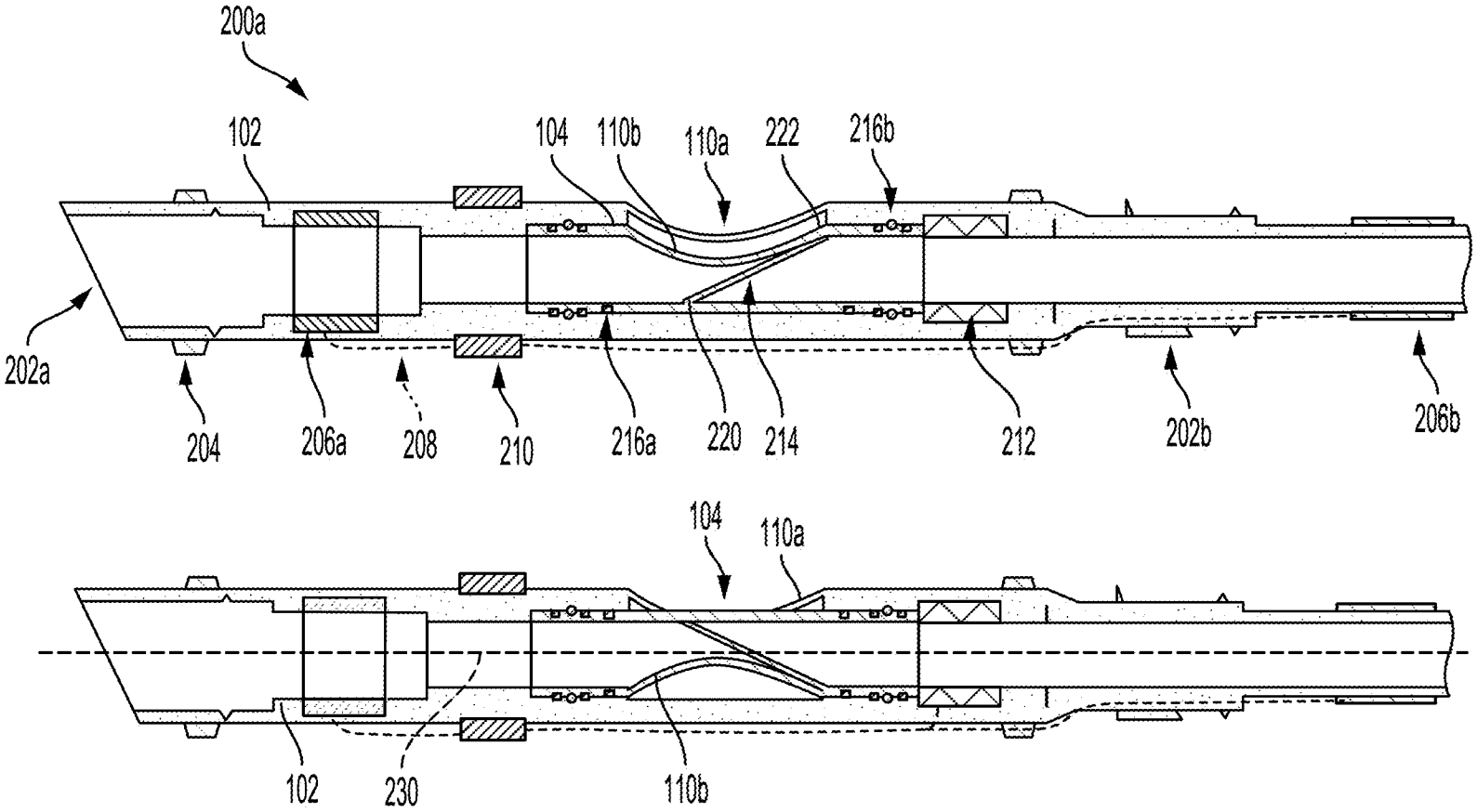
FIG. 2 is a sectional view of a downhole tool that includes a rotatable sleeve according to one example of the present disclosure.

FIG. 2 is a sectional view of a downhole tool 102 that includes a rotatable sleeve 104 according to one example of the present disclosure. The downhole tool 102 can include the rotatable sleeve 104, the first window 110*a*, a first self-orienting feature 202*a*, a second self-orienting feature 202*b*, one or more centralizing pads 204, a first coupling feature 206*a*, a second coupling feature 206*b*, a cable 208, an optional packing element 210, and a drive and communication module 212. Additional or alternative features may be included in the downhole tool 102. The first window 110*a* may be defined by a first opening in the downhole tool 102. For example, at least a portion of a housing of the downhole tool 102 may be removed to form the first opening or to form the first window 110*a*. The first window 110*a* can be any suitable shape, size, and the like for allowing tools, material, and the like to pass through the first window 110*a*, for example, to an adjacent lateral wellbore or other suitable location.

The first self-orienting feature 202*a* may include a latch or latch receptacle that may be grooved to receive a separate downhole tool in a particular, controlled orientation. For example, the separate downhole tool may be connected to the downhole tool 102 using the first self-orienting feature 202*a* and may be rotated or otherwise properly aligned (e.g., to perform one or more tasks in the wellbore 100) using the first self-orienting feature 202*a*. Additionally or alternatively, the second self-orienting feature 202*b* may include a latch or latch assembly that may be grooved to be inserted into a separate downhole tool in a particular, controlled orientation. For example, the downhole tool 102 may be connected to the separate downhole tool using the second self-orienting feature 202*b* and may be rotated or otherwise properly aligned (e.g., to perform one or more tasks in the wellbore 100) using the second self-orienting feature 202*b*.

The one or more centralizing pads 204 may be positioned on an external portion or surface of the downhole tool 102. The one or more centralizing pads 204 may contact the wellbore 100 or other flowline in which the downhole tool 102 can be disposed to centralize a position of the downhole tool 102 with respect to the wellbore 100 or the other flowline. For example, the one or more centralizing pads 204 can contact an interior surface of the wellbore 100 or the other flowline to prevent other components of the downhole tool 102 from contacting, and potentially being damaged by, the wellbore 100 or the other flowline. In some examples, the one or more centralizing pads 204 can be or include a rubber material, a polymeric material, or any other suitable material for centralizing the downhole tool 102.

The first coupling feature 206*a* can be positioned on a first end of the downhole tool 102 and of the rotatable sleeve 104. For example, the first coupling feature 206*a* can be positioned upstream from the rotatable sleeve 104 or may otherwise be positioned between the rotatable sleeve 104 and a surface of the wellbore 100. The first coupling feature 206*a* may be or include an electric wetmate, a hydraulic wetmate, an inductive coupler, or any combination thereof. In some examples, the first coupling feature 206*a* may be or include a female coupling feature that can receive male coupling features from other suitable downhole tools. The first coupling feature 206*a* may transfer power, data, and the like to the rotatable sleeve 104, through the rotatable sleeve 104, from the rotatable sleeve 104, or any combination thereof. The second coupling feature 206*b* can be positioned on a second end of the downhole tool 102 opposite the first end. Additionally or alternatively, the second coupling feature 206*b* can be positioned on a second end of the rotatable sleeve 104 opposite the first end. For example, the second coupling feature 206*b* can be positioned downstream from the rotatable sleeve 104 or may otherwise be positioned between the rotatable sleeve 104 and a terminating point of the wellbore 100. The second coupling feature 206*b* may be or include an electric wetmate, a hydraulic wetmate, an inductive coupler, or any combination thereof. In some examples, the second coupling feature 206*b* may be or include a male coupling feature that can connect to female coupling features from other suitable downhole tools. The second coupling feature 206*b* may transfer power, data, and the like to the rotatable sleeve 104, through the rotatable sleeve 104, from the rotatable sleeve 104, or any combination thereof.

The cable 208 may be or include an electric cable for transmitting electricity, a data cable for transmitting data, or a combination thereof. The cable 208 can be used to connect the first coupling feature 206*a* and the second coupling feature 206*b* to allow electricity, data, or the like to be transmitted across the downhole tool 102. The optional packing element 210 can be positioned on an exterior surface of the downhole tool 102 to assist the downhole tool 102 in performing tasks such as sealing at least a portion of the wellbore 100, etc. The drive and communication module 212 can be positioned in the downhole tool 102, for example adjacent to the rotatable sleeve 104. In some examples, the drive and communication module 212 can be communicatively coupled with the rotatable sleeve 104, electrically coupled with the rotatable sleeve 104, or a combination thereof. The drive and communication module 212 can provide power, such as electrical power, hydraulic power, and the like, to the rotatable sleeve 104, for example to cause the rotatable sleeve 104 to rotate.

The rotatable sleeve 104 can be positioned in the downhole tool 102. For example, the rotatable sleeve 104 can be positioned in an interior region of the downhole tool 102. The rotatable sleeve 104 can include the second window 110*b*, a deflection ramp 214, a first seal 216*a*, and a second seal 216*b*, though the rotatable sleeve 104 can include any additional or alternative components. The second window 110*b* may be defined by a second opening positioned on the rotatable sleeve 104. For example, at least a portion of a housing of the rotatable sleeve 104 may be removed to form the second opening or to form the second window 110*b*. The second window 110*b* can be any suitable shape, size, and the like for allowing tools, material, and the like to pass through the second window 110*b* and the first window 110*a*, for example, to an adjacent lateral wellbore or other suitable location. The second window 110*b* may be a similar or identical shape compared with the first window 110*a*. For example, if the first window 110*a* is rectangular, elliptical, circular, or the like, then the second window 110*b* may additionally be rectangular, elliptical, circular, or the like. Additionally or alternatively, the second window 110*b* may be a similar or identical size compared with that of the first window 110*a*. For example, if an opening area of the first window 110*a* is approximately 10 square feet (0.93 square meters), then the opening area of the second window 110*b* may be approximately (e.g., within +/−5%, within +/−10%, within +/−15%, etc.) 10 square feet (0.93 square meters). Any other suitable shapes or sizes for the first window 110*a* and the second window 110*b* are possible.

The deflection ramp 214 can be positioned in the rotatable sleeve 104 to facilitate deflection of tools, material, and the like from the downhole tool 102 to an adjacent wellbore or other locations downhole. For example, and when the first window 110*a* and the second window 110*b* are aligned, the deflection ramp 214 may extend from a base 220 of the rotatable sleeve 104 to a top end 222, adjacent to the first window 110*a* and the second window 110*b*, of the rotatable sleeve 104. An angle or other position parameter of the deflection ramp 214 may change when the rotatable sleeve 104 rotates. The first seal 216*a* and the second seal 216*b* may seal the rotatable sleeve 104 in the downhole tool 102, may facilitate rotation of the rotatable sleeve 104 in the downhole tool 102, and the like. For example, the first seal 216*a* may be or include a face seal that pressure-seals the rotatable sleeve 104, seals and protects the rotatable sleeve 104 from debris, and the like. Additionally or alternatively, the second seal 216*b* may be or include an array of bearings and seals for the bearings. The bearings may facilitate rotation of the rotatable sleeve 104, and the seals for the bearings may pressure-seal the bearings, may seal and protect the bearings from debris, and the like.

As illustrated in FIG. 2, the rotatable sleeve 104 can be rotated into a first configuration 200*a*, into a second configuration 200*b*, or in any other suitable configurations. The first configuration 200*a* may involve the rotatable sleeve 104 oriented in the downhole tool 102 such that the first window 110*a* and the second window 110*b* are at least approximately aligned. In some examples, the downhole tool 102 may receive power, such as from the surface of the wellbore 100, from a battery or other energy storage device on the downhole tool 102, etc., and may cause the rotatable sleeve 104 to rotate about a longitudinal axis 230. The longitudinal axis 230 may be shared by the downhole tool 102 and the rotatable sleeve 104 and may extend longitudinally through the downhole tool 102 and the rotatable sleeve 104. The rotatable sleeve 104 may be rotated until the second window 110*b* is at least approximately aligned with the first window 110*a*. The second window 110*b* may be at least approximately aligned with the first window 110*a* if a first direction, from a central point of the first window 110*a* and with respect to the longitudinal axis 230, extending normal from the first window 110*a* is approximately the same as (e.g., within a few percent) a second direction, from a central point of the second window 110*b* and with respect to the longitudinal axis 230, extending normal from the second window 110*b*. In some examples, the first configuration 200*a* may allow tools, material, and the like to be deflected from the downhole tool 102 into an adjacent, lateral wellbore or other suitable location to which to be deflected.

The second configuration 200*b* may involve the rotatable sleeve 104 oriented in the downhole tool 102 such that the first window 110*a* and the second window 110*b* are at least approximately misaligned. In some examples, the downhole tool 102 may receive power, such as from the surface of the wellbore 100, from a battery or other energy storage device on the downhole tool 102, etc., and may cause the rotatable sleeve 104 to rotate about a longitudinal axis 230. The rotatable sleeve 104 may be rotated until the second window 110*b* is at least approximately misaligned with the first window 110*a*. The second window 110*b* may be at least approximately misaligned with the first window 110*a* if the first direction of the first window 110*a* is approximately offset (e.g., within a few percent) by approximately 180° with respect to the second direction of the second window 110*b*. In some examples, the second configuration 200*b* may allow the wellbore 100, or any adjacent, lateral wellbores, to be sealed.

Figure 3:
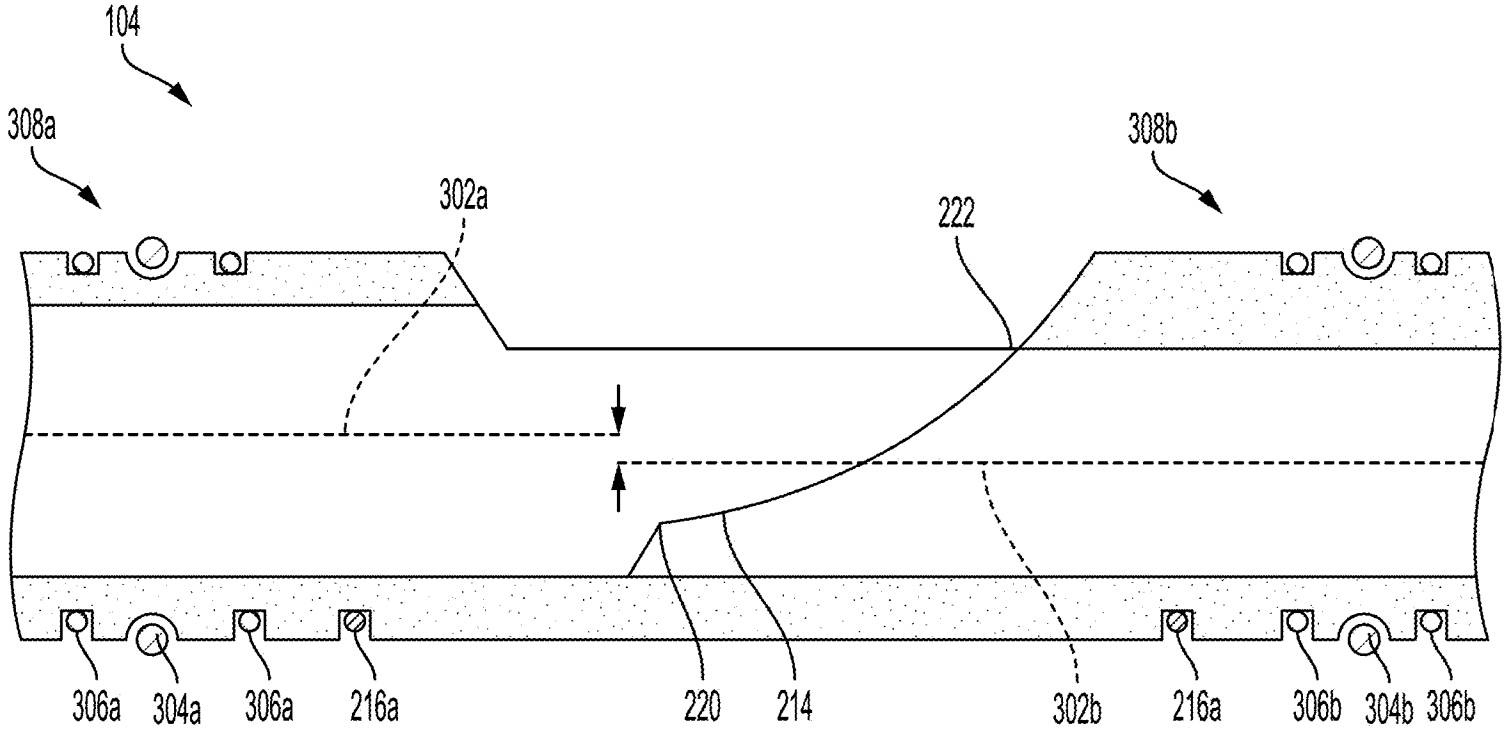
FIG. 3 is a sectional side view of a rotatable sleeve according to one example of the present disclosure.

FIG. 3 is a sectional side view of a rotatable sleeve 104 according to one example of the present disclosure. As illustrated, the rotatable sleeve 104 can include the second window 110*b*, the deflection ramp 214, the first seal 216*a*, a first axis 302*a*, a second axis 302*b*, bearings 304*a-b*, and seals 306*a-b*, though the rotatable sleeve 104 can include any other suitable components. The deflection ramp 214 can extend from the base 220 of the rotatable sleeve 104 to the top end 222 adjacent to the second window 110*b* of the rotatable sleeve 104. The rotatable sleeve 104 can have a first portion 308*a* and a second portion 308*b*, which may be separated by the deflection ramp 214 or any other component of the rotatable sleeve 104. The first portion 308*a* may extend along the first axis 302*a*, and the second portion 308*b* may extend along the second axis 302*b*. The first axis 302*a* and the second axis 302*b* may extend along a center line of the respective portion of the rotatable sleeve 104. An interior region of the first portion 308*a* may be larger than or otherwise offset from an interior region of the second portion 308*b*. Additionally or alternatively, the first axis 302*a* may be offset from the second axis 302*b* to cause tools, material, or the like to proceed along the deflection ramp 214 (e.g., instead of proceeding through the rotatable sleeve 104 and the downhole tool 102).

The first seal 216*a* may be positioned on the first portion 308*a* of the rotatable sleeve 104 and on the second portion 308*b* of the rotatable sleeve 104. The first seal 216*a* may be or include a face seal that pressure-seals the rotatable sleeve 104, seals and protects the rotatable sleeve 104 from debris, and the like. The bearings 304*a-b* may be positioned on the first portion 308*a* of the rotatable sleeve 104 and on the second portion 308*b* and may allow the rotatable sleeve 104 to rotate, for example without damaging the rotatable sleeve 104, the downhole tool 102, and the like. The seals 306*a-b* can be positioned on the first portion 308*a* of the rotatable sleeve 104 and on the second portion 308*b* and may be positioned around the bearings 304*a-b*. The seals 306*a-b* may be or include one or more seals that pressure-seal the bearings 304*a-b*, seal and protect the bearings 304*a-b* from debris, and the like.

Figure 4:
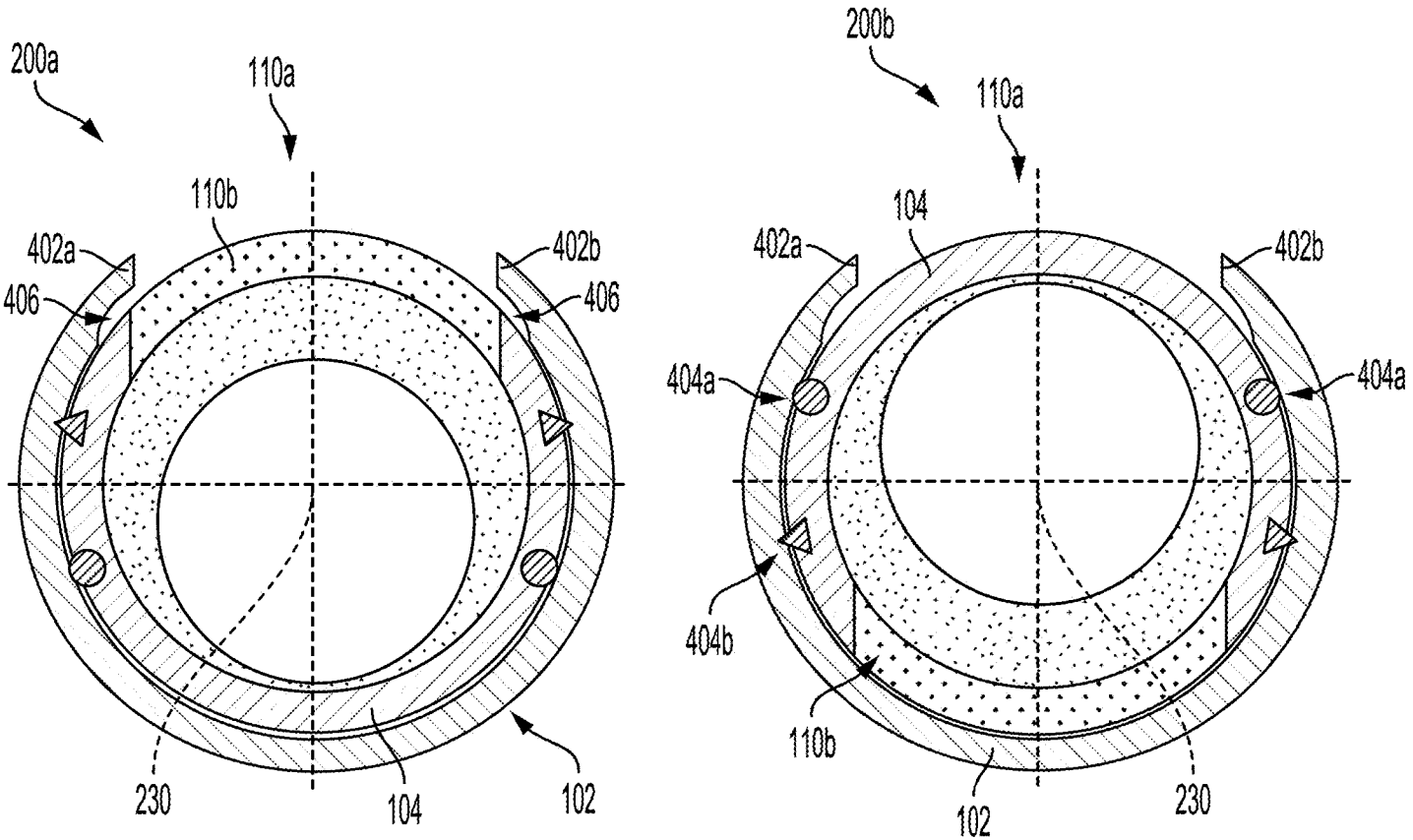
FIG. 4 is a cross-sectional view of a downhole tool that includes a rotatable sleeve according to one example of the present disclosure.

FIG. 4 is a cross-sectional view of a downhole tool 102 that includes a rotatable sleeve 104 according to one example of the present disclosure. As illustrated in FIG. 4, the rotatable sleeve 104 can be in the first configuration 200*a* or the second configuration 200*b*, though other suitable configurations or orientations are possible for the rotatable sleeve 104. The downhole tool 102 can include a first opening extending from a first external point 402*a* to a second external point 402*b*, and the first opening can define the first window 110*a*. The rotatable sleeve 104 can additionally include a first seal 404*a* and a second seal 404*b*. The first seal 404*a* may be or include a continuous loop O-ring seal, and the second seal 404*b* may be or include a wiper-type seal that can remove debris from a region between the rotatable sleeve 104 and the downhole tool 102 or that can otherwise prevent debris from settling between the rotatable sleeve 104 and the downhole tool 102. Additionally or alternatively, the downhole tool 102 can include a beveled region 406 that can guide the first seal 404*a*, the second seal 404*b*, or a combination thereof into proper place while rotating the rotatable sleeve 104.

As illustrated in FIG. 4, the first window 110*a* and the second window 110*b* can be at least approximately aligned in the first configuration 200*a* and at least approximately misaligned in the second configuration 200*b*. The rotatable sleeve 104 can be rotated, for example using electric power, hydraulic power, or the like, to adjust a configuration of the rotatable sleeve 104 to align or misalign the first window 110*a* and the second window 110*b* based at least in part on a task to be performed in the wellbore 100. A center axis of the rotatable sleeve 104 may be adjusted by rotating the rotatable sleeve 104. For example, the center axis may be offset, for example with respect to the longitudinal axis 230, in a first direction in the first configuration 200*a* and may be offset in a second direction, which may be different than the first direction, in the second configuration 200*b*. The offset of the center axis may be caused by the deflection ramp 214. For example, and in the first configuration 200*a*, the center axis may be offset in a direction that causes tools, material, and the like to deflect from the downhole tool 102 to an adjacent, lateral wellbore, while, in the second configuration 200*b*, the center axis may be offset in a direction that causes tools, material, and the like to flow through the downhole tool 102 and not to an adjacent, lateral wellbore.

Figure 5:
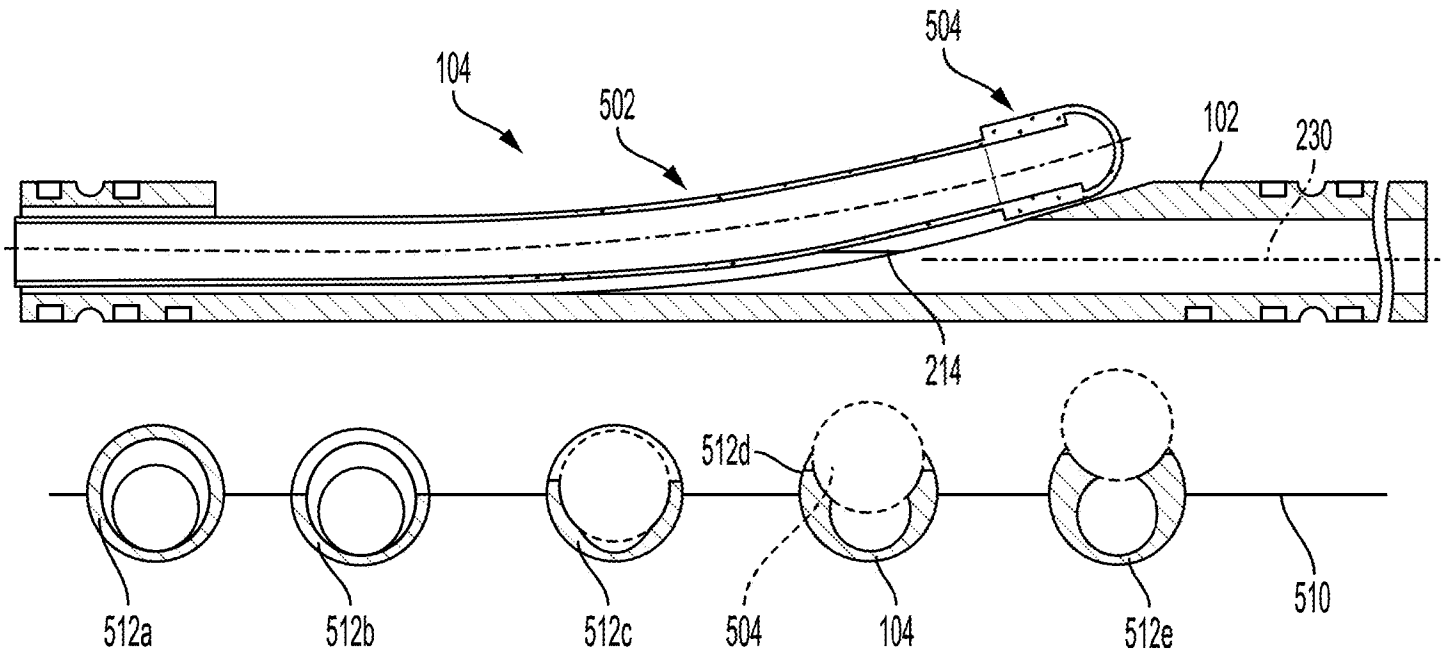
FIG. 5 is a sectional view of a deflection ramp of a downhole tool that includes a rotatable sleeve according to one example of the present disclosure.

FIG. 5 is a sectional view of a deflection ramp 214 of a downhole tool 102 that includes a rotatable sleeve 104 according to one example of the present disclosure. As illustrated in FIG. 5, an intervention assembly 502 is being passed into the downhole tool 102 and deflected out of the downhole tool 102 using the rotatable sleeve 104 in the first configuration 200*a*. The intervention assembly 502 can include an assembly head 504 that follows a path of the deflection ramp 214 to be deflected out of the downhole tool 102 and into an adjacent, lateral wellbore. The rotatable sleeve 104 can be rotated or otherwise adjusted into the first configuration 200*a* in which the first window 110*a* is aligned with the second window 110*b*. In the first configuration 200*a*, the rotatable sleeve 104 can receive the intervention assembly 502 and can guide the assembly head 504, and by extension the intervention assembly 502, along a path following the deflection ramp 214 to cause the intervention assembly 502 to be deflected out of the downhole tool 102 and into the adjacent, lateral wellbore.

FIG. 5 additionally illustrates a plot 510 of intervention assembly 502 position vs. a position of the rotatable sleeve 104. As illustrated in FIG. 5, the plot includes five points 512*a-e*, though other suitable numbers (e.g., more than five or less than five) of points are possible for the plot 510. The points 512*a-e* include discrete cross-sectional points along the intervention assembly 502, and, from left to right, the points 512*a-e* may illustrated a progression of the intervention assembly 502 along a path of the deflection ramp 214.

Figure 6:
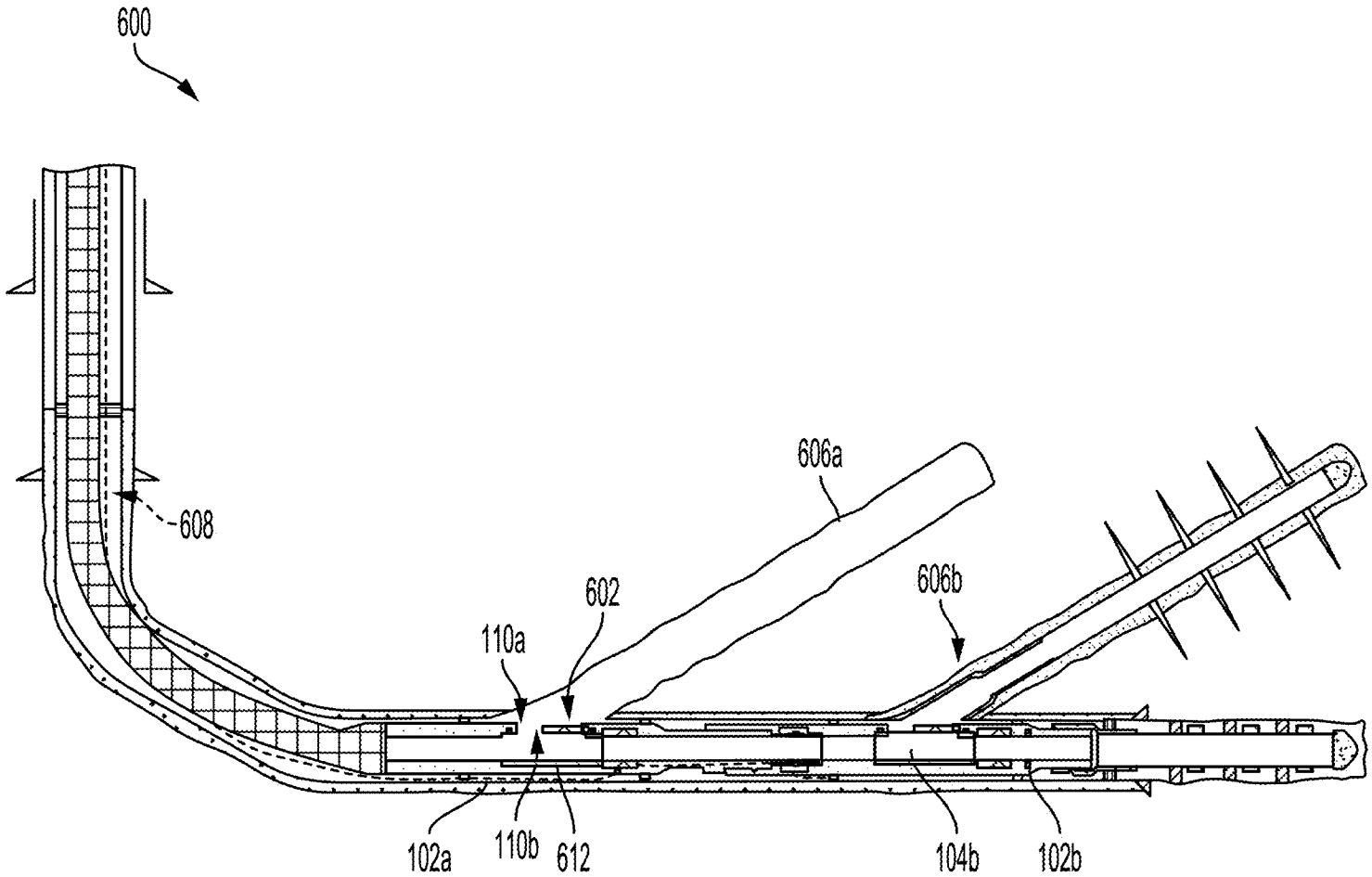
FIG. 6 is a sectional view of a wellbore that has a downhole tool that includes a rotatable sleeve and a dynamic deflection ramp according to one example of the present disclosure.

FIG. 6 is a sectional view of a wellbore 600 that has a downhole tool 102 that includes a rotatable sleeve 104 and a dynamic deflection ramp 602 according to one example of the present disclosure. As illustrated in FIG. 6, the wellbore 600 may be positioned adjacent to a first lateral wellbore 606*a* and a second lateral wellbore 606*b*, both of which may originate from a different point along the wellbore 600. Other suitable numbers (e.g., less than two or more than two) of lateral wellbores are also possible. As illustrated in FIG. 6, two downhole tools, such as a first downhole tool 102*a* and a second downhole 102*b*, are positioned in the wellbore 600 proximate to the first lateral wellbore 606*a* and the second lateral wellbore 606*b*, respectively, though other arrangements of the first downhole tool 102*a* and the second downhole 102*b* are possible.

The downhole tool 102, such as the first downhole tool 102*a*, can be positioned in the wellbore 600 using a work string 108 or using any other suitable conveyance tools or operations that can position the downhole tool 102 in the wellbore 600. The downhole tool 102 can be positioned approximately adjacent or otherwise proximate to the lateral wellbore 106 such as the first lateral wellbore 606*a*. The rotatable sleeve 104, such as rotatable sleeve 104*a*, can be rotated into a first configuration that can allow tools, material, and the like to be pass through the downhole tool 102 and into the lateral wellbore 606, or vice versa. Additionally or alternatively, the rotatable sleeve 104, such as the rotatable sleeve 104*a*, can be rotated into a second configuration that can allow the wellbore 100, the lateral wellbore 606, or any portions or subsets thereof to be sealed. The rotatable sleeve 104 can be rotated into any other suitable configuration to facilitate any other suitable task to be performed in the wellbore 100 or the lateral wellbore 606.

In some examples, the downhole tool 102 can include a first opening that can define a first window 110*a*, and the rotatable sleeve 104 can include a second opening that can define a second window 110*b*. The first window 110*a* and the second window 110*b* can have the same or similar shape, the same or similar size, and the like. For example, the first window 110*a* and the second window 110*b* can be rectangular, circular, elliptical, or the like. Additionally or alternatively, the first window 110*a* and the second window 110*b* may be sized to be within approximately +/−10% of one another, for example to allow a tool to be able to pass through the first window 110*a* and the second window 110*b*. Additionally or alternatively, the rotatable sleeve 104 can include the dynamic deflection ramp 602 that can allow tools, material, or the like to be deflected from the downhole tool 102 to the lateral wellbore 106. The dynamic deflection ramp 602 may extend along an external surface of the rotatable sleeve 104, or the second window 110*b* thereof, and may be actuated using pressure changes, hydraulic power, electric power, and the like to provide a ramp up which tools, material, and the like can travel to be deflected into the lateral wellbore 606.

Figure 7:
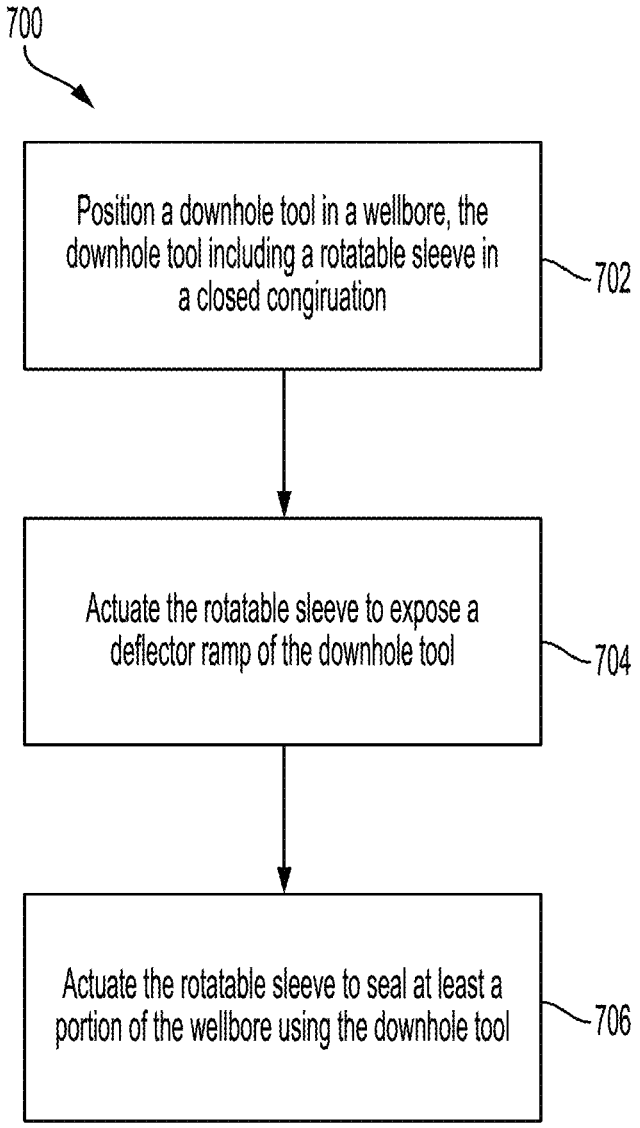
FIG. 7 is a flowchart of a process for using a downhole tool that includes a rotatable sleeve according to one example of the present disclosure.

FIG. 7 is a flowchart of a process 700 for using a downhole tool 102 that includes a rotatable sleeve 104 according to one example of the present disclosure. At block 702, a downhole tool 102 can be positioned in a wellbore 100. The downhole tool 102 can include a rotatable sleeve 104, and, in some examples, the rotatable sleeve 104 can be in a closed configuration (e.g., the second configuration 200*b*) for positioning the downhole tool 102 in the wellbore 100. The rotatable sleeve 104 may be in the closed configuration during run-in-hole to prevent debris or other material from settling in an interior region of the rotatable sleeve 104 or of the downhole tool 102. In other examples, the rotatable sleeve 104 may be in an open configuration, such as the first configuration 200*a*, during run-in-hole of the downhole tool 102.

At block 704, the rotatable sleeve 104 is rotated to expose a deflection ramp of the rotatable sleeve 104. The rotatable sleeve 104 can be rotated using electric power, hydraulic power, or a combination thereof, which may be supplied by or through the downhole tool 102. The rotatable sleeve 104 can be rotated, for example into the first configuration 200*a*, to align the first window 110*a* of the downhole tool 102 and the second window 110*b* of the rotatable sleeve 104 to allow tools, material, and the like to exit the downhole tool 102. When in the first configuration 200*a*, the rotatable sleeve 104 may have a deflection ramp, such as the deflection ramp 214, exposed. An intervention assembly or other suitable tool or material can be guide along the deflection ramp 214 to provide the intervention assembly or other suitable tool or material to an adjacent, lateral wellbore or other suitable location downhole.

At block 706, the rotatable sleeve 104 is rotated to facilitate a sealing operation in at least a portion of the wellbore 100. The rotatable sleeve 104 can be rotated using electric power, hydraulic power, or a combination thereof, which may be supplied by or through the downhole tool 102. The rotatable sleeve 104 can be rotated, for example into the second configuration 200*b*, to misalign (e.g., offset by between 20° to 340°, offset by approximately 180°, etc.) the first window 110*a* of the downhole tool 102 and the second window 110*b* of the rotatable sleeve 104 to allow a sealing operation to be performed. Once the rotatable sleeve 104 is in the second configuration 200*b* and the first window 110*a* is misaligned with the second window 110*b*, the wellbore 100, or any lateral wellbores branching therefrom, can be pressure-sealed or otherwise suitably sealed to facilitate one or more other wellbore operations in the wellbore 100 or any lateral wellbores branching therefrom.

In some aspects, systems and downhole tools for a rotatable sleeve for a downhole tool are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a downhole tool positionable in a wellbore for performing one or more tasks associated with a wellbore operation; and a rotatable sleeve positionable in the downhole tool, the rotatable sleeve rotatable within the downhole tool into: a first configuration in which a first window of the downhole tool is aligned with a second window of the rotatable sleeve to facilitate a first task in the wellbore; and a second configuration in which the first window is misaligned with the second window to facilitate a second task in the wellbore, the first task being different than the second task.

Example 2 is the system of example 1, wherein the downhole tool comprises a first opening defining the first window, and wherein the rotatable sleeve comprises a second opening defining the second window.

Example 3 is the system of any of examples 1-2, wherein the first opening and the second opening are approximately the same shape, and wherein the first opening and the second opening are approximately the same size.

Example 4 is the system of example 1, wherein the rotatable sleeve is rotatable using electrical power or hydraulic power.

Example 5 is the system of example 1, wherein in the first configuration, the first window and the second window are aligned such that a first direction, from a central point of the first window and with respect to a longitudinal axis shared by the downhole tool and the rotatable sleeve, extending normal from the first window is approximately the same as a second direction, from a central point of the second window and with respect to the longitudinal axis, extending normal from the second window.

Example 6 is the system of any of examples 1 and 5, wherein in the second configuration, the first window and the second window are misaligned such that the first direction is approximately 180 degrees offset from the second direction.

Example 7 is the system of example 1, wherein the rotatable sleeve comprises a deflection ramp, and wherein, when the first window and the second window are aligned, the deflection ramp is hydraulically actuatable to allow a tool to be positioned in a lateral wellbore adjacent to the wellbore.

Example 8 is a downhole tool comprising: a housing positionable in a wellbore; and a rotatable sleeve positionable in the housing, the rotatable sleeve rotatable within the housing into: a first configuration in which a first window of the housing is aligned with a second window of the rotatable sleeve to facilitate a first task in the wellbore; and a second configuration in which the first window is misaligned with the second window to facilitate a second task in the wellbore, the first task being different than the second task.

Example 9 is the downhole tool of example 8, wherein the housing comprises a first opening defining the first window, and wherein the rotatable sleeve comprises a second opening defining the second window.

Example 10 is the downhole tool of any of examples 8-9, wherein the first opening and the second opening are approximately the same shape, and wherein the first opening and the second opening are approximately the same size.

Example 11 is the downhole tool of example 8, wherein the rotatable sleeve is rotatable using electrical power or hydraulic power.

Example 12 is the downhole tool of example 8, wherein in the first configuration, the first window and the second window are aligned such that a first direction, from a central point of the first window and with respect to a longitudinal axis shared by the housing and the rotatable sleeve, extending normal from the first window is approximately the same as a second direction, from a central point of the second window and with respect to the longitudinal axis, extending normal from the second window.

Example 13 is the downhole tool of any of examples 8 and 12, wherein in the second configuration, the first window and the second window are misaligned such that the first direction is approximately 180 degrees offset from the second direction.

Example 14 is the downhole tool of example 8, wherein the rotatable sleeve comprises a deflection ramp, and wherein, when the first window and the second window are aligned, the deflection ramp is hydraulically actuatable to allow a tool to be positioned in a lateral wellbore adjacent to the wellbore.

Example 15 is a system comprising: a downhole tool positionable in a wellbore for performing one or more tasks associated with a wellbore operation, the downhole tool comprising a first opening defining a first window; and a rotatable sleeve comprising a second opening defining a second window, the rotatable sleeve positionable in the downhole tool and rotatable within the downhole tool into: a first configuration in which the first window of the downhole tool is aligned with the second window of the rotatable sleeve to facilitate a first task in the wellbore; and a second configuration in which the first window is misaligned with the second window to facilitate a second task in the wellbore, the first task being different than the second task.

Example 16 is the system of example 15, wherein the first opening and the second opening are approximately the same shape, and wherein the first opening and the second opening are approximately the same size.

Example 17 is the system of example 15, wherein the rotatable sleeve is rotatable using electrical power or hydraulic power.

Example 18 is the system of example 15, wherein in the first configuration, the first window and the second window are aligned such that a first direction, from a central point of the first window and with respect to a longitudinal axis shared by the downhole tool and the rotatable sleeve, extending normal from the first window is approximately the same as a second direction, from a central point of the second window and with respect to the longitudinal axis, extending normal from the second window.

Example 19 is the system of any of examples 15 and 18, wherein in the second configuration, the first window and the second window are misaligned such that the first direction is approximately 180 degrees offset from the second direction.

Example 20 is the system of example 15, wherein the rotatable sleeve comprises a deflection ramp, and wherein, when the first window and the second window are aligned, the deflection ramp is hydraulically actuatable to allow a tool to be positioned in a lateral wellbore adjacent to the wellbore.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a downhole tool positionable in a wellbore for performing one or more tasks associated with a wellbore operation; and a rotatable sleeve positionable in the downhole tool, the rotatable sleeve rotatable within the downhole tool into:

a first configuration in which a first window of the downhole tool is aligned with a second window of the rotatable sleeve to facilitate a first task in the wellbore; and a second configuration in which the first window is misaligned with the second window to facilitate a second task in the wellbore, the first task being different than the second task, the second task comprising a sealing task for sealing at least a portion of the wellbore.

2. The system of claim 1, wherein the downhole tool comprises a first opening defining the first window, and wherein the rotatable sleeve comprises a second opening defining the second window.

3. The system of claim 2, wherein the first opening and the second opening are approximately the same shape, and wherein the first opening and the second opening are approximately the same size.

4. The system of claim 1, wherein in the first configuration, the first window and the second window are aligned such that a first direction, from a central point of the first window and with respect to a longitudinal axis shared by the downhole tool and the rotatable sleeve, extending normal from the first window is approximately the same as a second direction, from a central point of the second window and with respect to the longitudinal axis, extending normal from the second window.

5. The system of claim 4, wherein in the second configuration, the first window and the second window are misaligned such that the first direction is approximately 180 degrees offset from the second direction.

6. The system of claim 1, wherein the rotatable sleeve comprises a deflection ramp, and wherein, when the first window and the second window are aligned, the deflection ramp is hydraulically actuatable to allow a tool to be positioned in a lateral wellbore adjacent to the wellbore.

7. The system of claim 1, wherein a lateral wellbore adjacent to the wellbore is sealable via the sealing task.

8. A downhole tool comprising:

a housing positionable in a wellbore; and a rotatable sleeve positionable in the housing, the rotatable sleeve rotatable within the housing into:

a first configuration in which a first window of the housing is aligned with a second window of the rotatable sleeve to facilitate a first task in the wellbore; and a second configuration in which the first window is misaligned with the second window to facilitate a second task in the wellbore, the first task being different than the second task, the second task comprising a sealing task for sealing at least a portion of the wellbore.

9. The downhole tool of claim 8, wherein the housing comprises a first opening defining the first window, and wherein the rotatable sleeve comprises a second opening defining the second window.

10. The downhole tool of claim 9, wherein the first opening and the second opening are approximately the same shape, and wherein the first opening and the second opening are approximately the same size.

11. The downhole tool of claim 8, wherein the rotatable sleeve is rotatable using electrical power or hydraulic power.

12. The downhole tool of claim 8, wherein in the first configuration, the first window and the second window are aligned such that a first direction, from a central point of the first window and with respect to a longitudinal axis shared by the housing and the rotatable sleeve, extending normal from the first window is approximately the same as a second direction, from a central point of the second window and with respect to the longitudinal axis, extending normal from the second window.

13. The downhole tool of claim 12, wherein in the second configuration, the first window and the second window are misaligned such that the first direction is approximately 180 degrees offset from the second direction.

14. The downhole tool of claim 8, wherein the rotatable sleeve comprises a deflection ramp, and wherein, when the first window and the second window are aligned, the deflection ramp is hydraulically actuatable to allow a tool to be positioned in a lateral wellbore adjacent to the wellbore.

15. A system comprising:

a downhole tool positionable in a wellbore for performing one or more tasks associated with a wellbore operation, the downhole tool comprising a first opening defining a first window; and a rotatable sleeve comprising a second opening defining a second window, the rotatable sleeve positionable in the downhole tool and rotatable within the downhole tool into:

a first configuration in which the first window of the downhole tool is aligned with the second window of the rotatable sleeve to facilitate a first task in the wellbore; and a second configuration in which the first window is misaligned with the second window to facilitate a second task in the wellbore, the first task being different than the second task, the second task comprising a sealing task for sealing at least a portion of the wellbore.

16. The system of claim 15, wherein the first opening and the second opening are approximately the same shape, and wherein the first opening and the second opening are approximately the same size.

17. The system of claim 15, wherein the rotatable sleeve is rotatable using electrical power or hydraulic power.

18. The system of claim 15, wherein in the first configuration, the first window and the second window are aligned such that a first direction, from a central point of the first window and with respect to a longitudinal axis shared by the downhole tool and the rotatable sleeve, extending normal from the first window is approximately the same as a second direction, from a central point of the second window and with respect to the longitudinal axis, extending normal from the second window.

19. The system of claim 18, wherein in the second configuration, the first window and the second window are misaligned such that the first direction is approximately 180 degrees offset from the second direction.

20. The system of claim 15, wherein the rotatable sleeve comprises a deflection ramp, and wherein, when the first window and the second window are aligned, the deflection ramp is hydraulically actuatable to allow a tool to be positioned in a lateral wellbore adjacent to the wellbore.

* * * * *